United States Patent [19]

Ignazio

[11] 4,308,485

[45] Dec. 29, 1981

[54] SHADOW MASK SUPPORT IN A COLOR CATHODE RAY TUBE

[75] Inventor: Cormio Ignazio, Rome, Italy

[73] Assignee: Videocolor, S. A., France

[21] Appl. No.: 18,848

[22] Filed: Mar. 8, 1979

[30] Foreign Application Priority Data

Mar. 13, 1978 [FR] France ..... 78 07191

[51] Int. Cl.[3] ..... H01J 29/07

[52] U.S. Cl. ..... 313/407

[58] Field of Search ..... 313/407, 405, 406, 404, 313/402

[56] References Cited

U.S. PATENT DOCUMENTS 3,368,098 2/1968 Demmy ..... 313/407
3,585,431 6/1971 Long ..... 313/407
3,639,799 2/1972 Kirchner ..... 313/402
3,772,555 11/1973 McKee et al. ..... 313/407 X

FOREIGN PATENT DOCUMENTS 2336789 12/1976 France .

*Primary Examiner*—Palmer C. Demeo
*Attorney, Agent, or Firm*—Kane, Dalsimer, Kane, Sullivan and Kurucz

[57] ABSTRACT

A shadow-mask cathode ray tube for the visualization of colors, such as in television, where the peripheral edge of the mask is rigid with the frame fixed on the tube plate and is in contact with said frame only in areas spaced from each other. The frame is formed with bosses providing its contact in reduced cross-section areas spaced from each other with the edge of the mask.

4 Claims, 4 Drawing Figures

SHADOW MASK SUPPORT IN A COLOR CATHODE RAY TUBE

The invention relates to a cathode ray tube of the shadow-mask type for the visualization of colours, particularly in television.

It is known that the colour television tubes have, in the vicinity of the plate, that is in the frontal portion of the tube on which are deposited the phosphors, a mask made for instance of a metallic plate or grid of about 1/10th of mm in thickness comprising a grating with openings of oblong shape or other. Opposite each of said openings are three areas, of small surfaces, of the phosphors layer; said areas assume when they are excited respectively the green, red and blue colours. The relative positions of the electron guns, of the mask openings and of the areas of the phosphors layer as well as the control means for the beams generated by the guns are such that each of said electron guns can only excite the phosphors of a determined colour.

The position of the mask relative to the phosphors, that is relative to the plate, should therefore be fixed with the greatest precision for a good operation of the tube, and this whatever the operation conditions of the tube. It is therefore necessary to take particular precautions so that said relative position is not changed when the mask heats up under the effect of the electrons projected by the guns.

In a known tube, the mask is fixed by a peripheral edge to a frame, said edge being formed with bosses and being in contact with the frame through said bosses. The frame is rigid with the plate through fixation means which are specially adapted for minimizing the heating consequences of the mask on its position relative to the plate.

The object of the invention is to reduce still more the effects of the temperature variations of the mask on its position relative to the plate.

A further object of the invention is to provide a particularly simple and economical production of the shadowmask tubes for colour television.

The tube according to the invention is characterized in that the frame is formed with bosses for providing its contact in areas of reduced cross-section, spaced from each other, with the mask edge.

It has been established that with such a disposition, position variations of the mask relative to the phosphors layer were smaller than in the previously known tubes. It has even been established that it was not then necessary to foresee fixation means of the frame to the plate which should be specially adapted for "adsorbing" the dilatations of the mask.

Moreover, the frame bosses increase the mechanical rigidity thereof.

It is advantageous, particularly for reducing the size of the tube, that the contact points between the mask edge and the frame are on the inner periphery of said frame.

The invention relates also to a frame and to a mask for cathode ray tubes.

Further objects, dispositions and advantages of the invention will become more apparent from the description of one of its embodiments, said description being made with reference to the accompanying drawings wherein.

Figure 1:
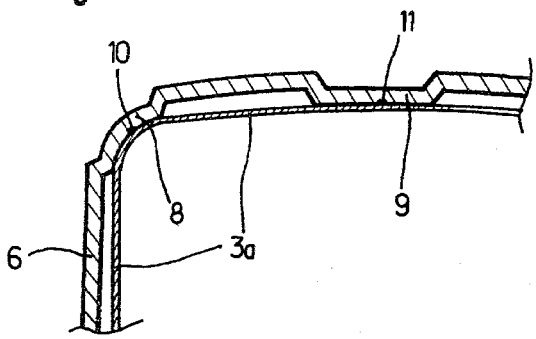
FIG. 1 is a schematic cross-sectional view, along line I—I of FIG. 2, of a portion of the mask and of the frame of the tube according to the invention.

The colour television tube shown partly in the Figures comprises a frontal portion or plate 1 (FIG. 4) on the inner face 1*a* of which is deposited the phosphors layer of the tube. This plate 1 is formed with an edge 2 for its connection with the conical rear portion (not shown) of the tube.

Opposite face 1*a* is arranged a mask 3 which is made of a thin metallic plate the thickness of which is of the order of 1/10th of a mm, which is hollowed to form a grid of holes (not shown) and which is formed with an edge 3*a* fixed to a profiled metallic frame 4 having the general shape of an angle iron with two branches 5 and 6. The edge 3*a* is fixed on the inner face (that is the face which is turned towards the space delimiting the frame) of branch 6 of said frame. Fixation means 7 are provided for jointing the frame and therefore the shadow-mask to the edge 2 of plate 1.

The inner face of branch 6 of frame 4 is formed with bosses 8, 9, etc. (FIG. 1) arranged at a distance from each other and regularly on the periphery of the frame.

The contact between the edge 3*a* and the frame is provided only through said bosses. The fixation of said edge to the frame is effected by soldering points 10, 11 at the contact points of edge 3*a* with the bosses 8, 9.

In the example, the bosses are of a general rectangular shape and are formed by snarling the branch 6 of frame 4.

Figure 2:
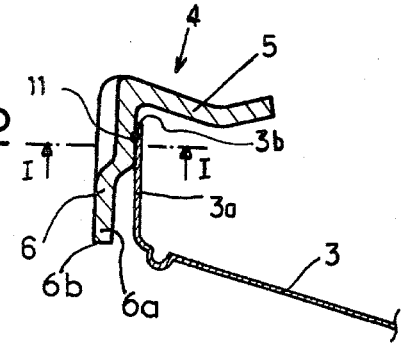
FIG. 2 is another schematic cross-sectional view according to a plane perpendicular to the plate, of portions of the tube shown in FIG. 1.

Moreover, said bosses 8, 9 occupy but a portion of the width of branch 6 (FIG. 2) which is closest to the branch 5. The branch 6 has therefore a half-width 6*a* in the vicinity of its free edge 6*b* which is free of bosses and is at a distance from edge 3*a*.

Figure 3:
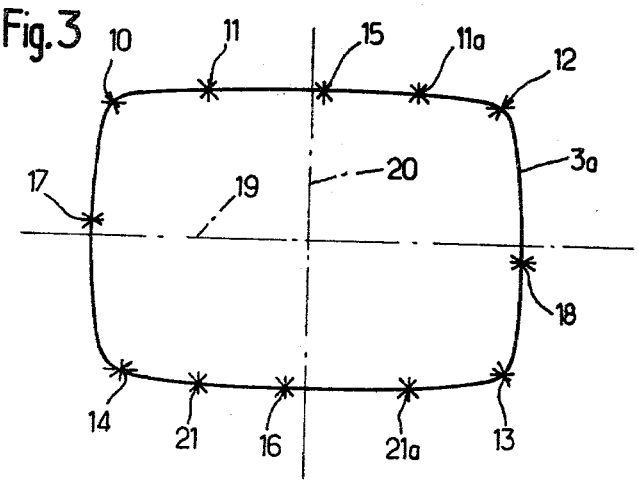
FIG. 3 shows the position of the fixation points of the mask to the tube frame shown partly on FIGS. 1 and 2.

In FIG. 3 has been schematically shown the general appearance of the edge 3*a* of mask 3 with the fixation points of said edge 3*a* to the branch 6 of frame 4 shown in the shape of crosses. There are foreseen four fixation points 10, 12, 13 and 14 at the respective apexes of the substantially rectangular shaped frame. Further fixation points 15, 16, 17 and 18 are also provided in the vicinity of the medium axes (mid-perpendicular lines) 19 and 20 of the sides of the rectangle formed by edge 3*a*. However, the latter fixation points are not exactly on said axes 19 and 20 but slightly shifted relative to the latter and moreover they are not on the same side relative to said axis. Thus, the fixation point 15 is on the right hand side (in FIG. 3) of axis 20, whereas point 16 is on the left hand side of the same axis 20. The points 17 and 18 are respectively under and above axis 19. Finally, there is foreseen further fixation points 11, 11*a*, 21, 21*a* which are respectively between points 10 and 15, 15 and 12, 14 and 16, 16 and 13.

In the example, the longer diagonal of the mask having a length of 67 cm, the height of each boss is of 1.4 mm or more, their length (the dimension along the longitudinal direction of branch 6) is of 25 mm or less, and the soldering points (for instance point 11, FIG. 2), are at a distance of 3 mm or more from the free end 3*b* of the mask edge. The distance between point 15 and axis 20 is of the order of 6 mm; the point 16 is at the same distance from this axis 20. The points 17 and 18 are arranged at about 10 mm from axis 19. Finally, points 11, 11*a* and 21, 21*a* are each at about 130 mm from axis 20.

It has been established that with the disposition according to the invention where the frame has the bosses and the edge 3*a* of mask 3 is only in contact with the frame or these bosses, along points spaced from each other, and not on the whole periphery of the frame or on bosses of the edge of the mask as in the previously known tubes. Temperature variations of the mask now have minimum consequences on the position of the latter relative to the plate. It is believed that this result originates in the fact that, during a temperature rise, the dilatations of the mask are absorbed by the portions of edge 3*a* which are between the bosses. To this result contributes also the fact that portion 6*a* of edge 6 of the frame is spaced apart towards the outside from the edge 3*a* of the mask.

Moreover, the bosses improve the mechanical rigidity of the frame 4.

Figure 4:
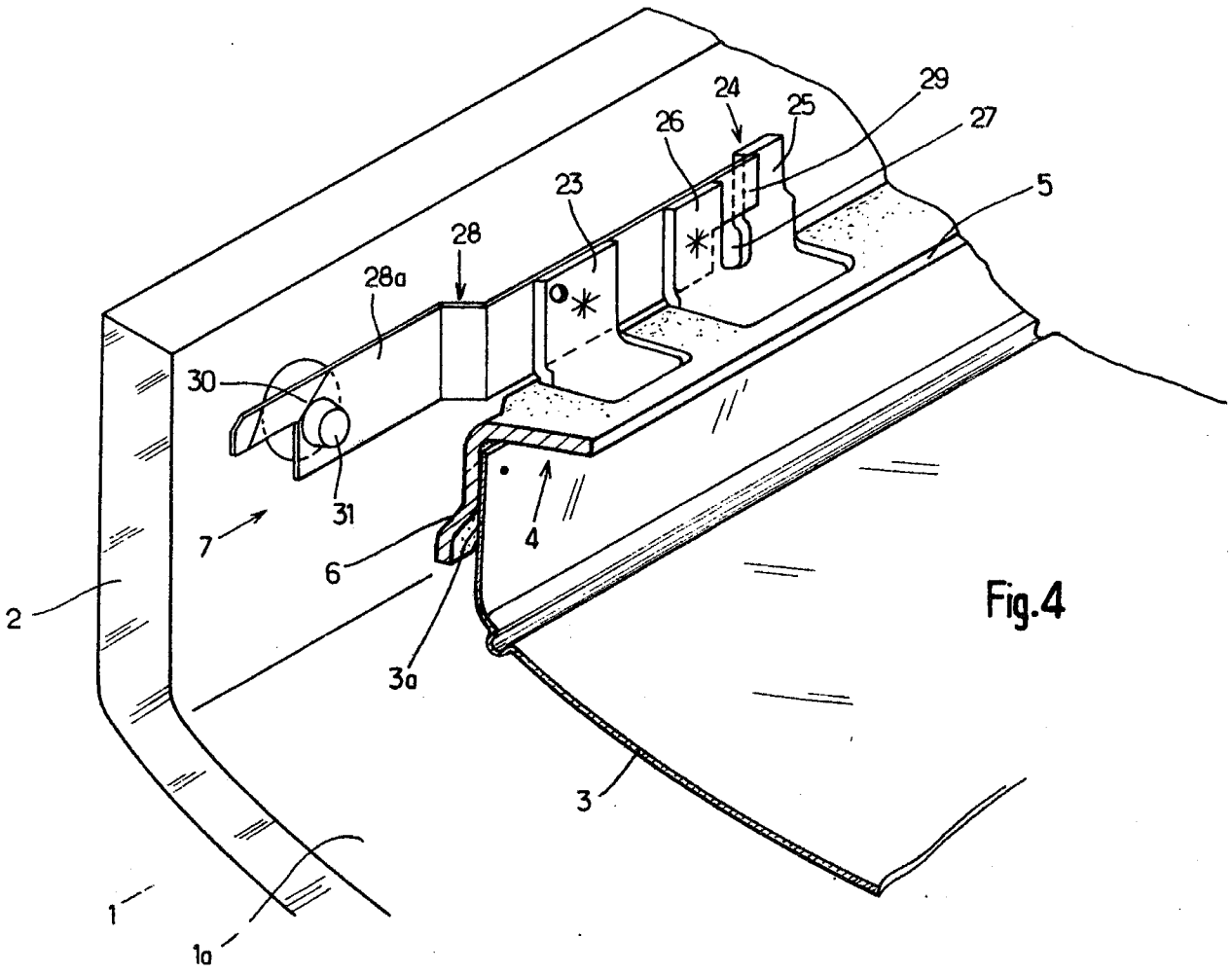
FIG. 4 is a perspective more detailed view of a portion of the tube according to the invention.

The reduction of the effects of the temperature variations on the position of the mask relative to the plate permits to do away with particular dispositions for the fixation of the frame onto the edge 2 of the plate, as is shown in FIG. 4.

For said fixation, the frame 4 is formed with couples of tongues 23 and 24 obtained from cuttings of branch 5 which are folded to form a prolongation of branch 6, on the opposite side relative to branch 5. The tongue 24 is formed with two branches 25 and 26 separated by a slot 27. Said branches 25 and 26 are in planes displaced one relative to the other, so that the foreward face of branch 25 is substantially on the same level as the rear face of branch 26, so that the end 29 of a fixation lug 28 may be inserted between said rear face of branch 26 and the foreward face of branch 25. The end 29 of the lug 28 is, moreover, soldered to the front face of branch 26. The lug 28 is also soldered to the rear face of tongue 23 and the other end 30 of said lug 28 is fixed via a button 31 to the edge 2 of plate 1.

The lug 28 is formed with two portions in parallel planes. Portion 28*a* terminating in end 30 is applied against the inner face of edge 2 of the plate whereas, as was discussed hereabove, the portion 28*b* terminating in end 29 is applied by soldering points against the tongues 23 and 24.

The lug 28 is a simple metallic blade without special means for compensating eventual deformations caused by temperature variations, said deformations being, as already mentioned, compensated by the presence of the bosses of branch 6 of frame 4.

It is not indispensable that the bosses be made of snarled parts, and as an alternative, said bosses may be protrusions of the frame.

Preferably, the number of soldering points of the edge of the mask onto the frame is at least equal to four, said four soldering points being in the vicinity of the apexes of the rectangle formed by said edge. For large dimension shadow-mask tubes as is the case in the example described with reference to the Figures, the number of soldering points is higher.

Finally, it is not indispensable that the mask edge be soldered on all the bosses. Said edge may be in simple contact with some of the bosses.

I claim:

1. In a colour cathode ray-tube having a plate and a shadow mask mounted behind said plate, the combination of a shadow mask having a light grid face formed integrally with a rearwardly extending peripheral wall edge substantially rectangular in shape and a rigid frame secured to said plate comprising a substantially rectangular skirt having a front and rear edge with said skirt substantially parallel to and fitting with said wall edge of the mask, said wall edge of the mask and said skirt of the frame being secured to one another by a plurality of welding points spaced from each other, said skirt comprises a plurality of bosses spaced apart therearound which provide contact of said skirt with said wall edge along a plurality of areas of limited extent at spaced apart locations therearound, said bosses extend only part of the distance between said front and rear edge and protrude inwardly of said skirt adjacent to said rear edge thereof, said wall edge extending between a peripheral line around said light grid face and a rearward edge thereof, and said wall edge contacts said bosses near said rearward edge to leave a contactless peripheral zone between said skirt and said wall edge next to said peripheral line.

2. A shadow mask colour cathode ray tube having an axis and comprising a shadow mask having a light grid face formed integrally with a peripheral substantially rectangular wall edge extending in a direction substantially parallel to the axis of the tube rearwardly of said light grid face, and a rigid frame comprising a substantially rectangular skirt substantially parallel and secured to said wall edge of the mask, said skirt having a plurality of spaced apart inwardly protruding bosses therearound, wherein said wall edge contacts said bosses along a plurality of respective spaced apart areas rearwardly adjacent said edge to leave a peripheral area of said wall edge adjacent said light grid face free of contact with said skirt.

3. A tube according to claim 2, wherein said skirt has a front and a rear boundary spaced in a direction substantially parallel to said axis and said bosses are located adjacent said rear boundary and have an extent parallel to said axis less than the distance between said front and rear boundary to leave a contactless zone on said skirt opposite said peripheral area of said wall edge at a short distance therefrom.

4. A tube according to claim 3 further comprising a plurality of welding points to secure said wall edge to said skirt at the location of said bosses.

* * * * *